United States Patent [19]

Lindgren

[11] 4,119,949

[45] Oct. 10, 1978

[54] FIRE DETECTOR UTILIZING TWO BANDWIDTHS OF RADIATION

[75] Inventor: Erik Gustaf Lindgren, Stockholm, Sweden

[73] Assignee: Telefonaktiebolaget L M Ericsson, Stockholm, Sweden

[21] Appl. No.: 780,009

[22] Filed: Mar. 22, 1977

[30] Foreign Application Priority Data

Apr. 15, 1976 [SE] Sweden ..... 7604502

[51] Int. Cl.[2] ..... G08B 17/12

[52] U.S. Cl. ..... 340/630; 340/600

[58] Field of Search ..... 340/228 S, 227 R; 250/339, 578

[56] References Cited

U.S. PATENT DOCUMENTS 3,643,093 2/1972 Dietz ..... 340/227 R 3,799,672 3/1974 Vurek ..... 250/399

3,846,772 11/1974 Peberdy ..... 340/227 R

*Primary Examiner*—Glen R. Swann, III

*Attorney, Agent, or Firm*—Hane, Roberts, Spiecens & Cohen

[57] ABSTRACT

An optical fire detector has a radiation-emitting means which emits a beam of radiation which, after passing through an intermediate air-medium is received by a radiation detecting means for providing an alarm upon an obscuration of the beam or radiation. The radiation-detecting means has first means for individually measuring the intensity in a first and a second wave-length band of the beam of radiation and second means for comparing the invididually measured intensities to provide the alarm upon a predetermined difference between such intensities.

3 Claims, 3 Drawing Figures

FIRE DETECTOR UTILIZING TWO BANDWIDTHS OF RADIATION

BACKGROUND OF THE INVENTION

The invention relates to an optical fire detector in which a radiation-emitting means is arranged to emit a beam of radiation and a radiation detecting means is arranged to receive the beam of radiation after it has passed through an intermediate air medium and to provide an alarm upon an obscuration of the beam of radiation.

In the Swedish Pat. No. 335,080 an optical fire detector is described in which a reduced sensitivity to disturbances is obtained by dividing a beam of radiation into two parallel beams of radiation which pass separated measuring chambers in order to be influenced differently by fire and the intensities of which are measured separately and are compared mutually, an alarm being provided upon a predetermined difference between the intensities.

The British Pat. No. 1,405,615 describes an optical fire detector which can use an arbitrary measuring chamber, for example, a chamber arranged so that a beam of radiation passes across the chamber. Here a reduced sensitivity to disturbances is obtained by using a source of radiation which is intensity modulated with a definite frequency and a radiation detector which is frequency selective with respect to the frequency of the intensity modulation of the radiation source. This type of optical fire detector is suitable to respond to heat as well as to smoke. Its ability to provide an early fire alarm is, however, quite limited due to the fact that there is no difference measurement of the intensities of two beams of radiation. In addition, the above-mentioned fire detector described in the Swedish Pat. No. 335,080 is unable to provide an early fire alarm since it takes considerable time to carry out a sample of the air from a secured chamber to a separate measuring chamber.

An object of the invention is of providing an optical fire detector which can use an arbitrary measuring chamber and which combines a low sensitivity to disturbances with the capability to provide an early fire alarm.

BRIEF DESCRIPTION OF THE DRAWINGS

The invention, the characterizing features of which appear from the appended claims will now be explained more in detail with reference to the accompanying drawing where:

DESCRIPTION OF THE PREFERRED EMBODIMENTS

Figure 1:
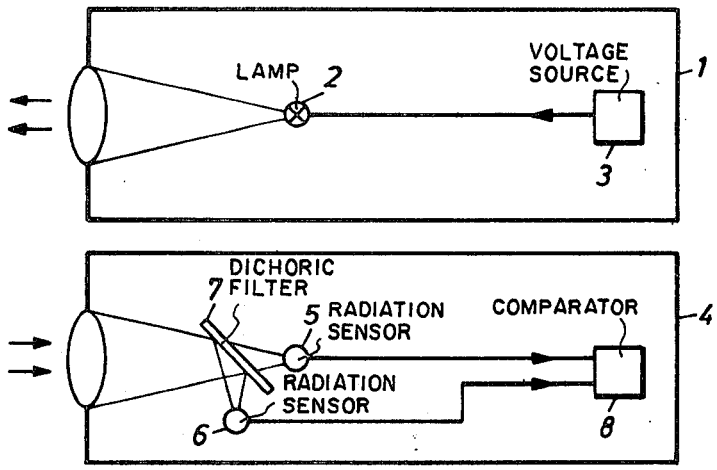
FIG. 1 shows an embodiment with two radiation-detecting means.

FIG. 1 shows an optical fire detector in which a radiation-emitting means 1 comprises an incandescent lamp 2 connected to a voltage source 3 and is arranged to emit an outgoing beam of radiation; and a radiation-detecting means 4 is arranged to receive an incoming beam of radiation provided by reflection of the outgoing beam of radiation via a reflector (not shown) located at a distance and to provide an alarm upon a partial obscuration of the incoming beam of radiation.

The radiation-detecting means 4 comprises two radiation-sensing means 5 and 6 arranged for a selective measurement of the intensity in a first and second wavelength band respectively of the beam of radiation. For this purpose a dichroic filter 7 is placed in front of the one radiation-sensing element 5 in the path of the incoming beam of radiation and arranged in an angle of 45 degrees relative thereto. The second radiation-sensing means 6 is placed in the path of a portion of the incoming beam of radiation reflected by the dichroic filter 7. The dichroic filter 7 which is known per se passes for example the long-wave radiation to the radiation sensing element 5 and reflects the short-wave radiation to the radiation sensing element 6. The radiation sensors 5 and 6 are in a manner known per se connected to a comparator means 8 arranged to compare their measures of the intensities of the respective beams of radiation and to provide an alarm upon a predetermined difference between these intensities.

Figure 2:
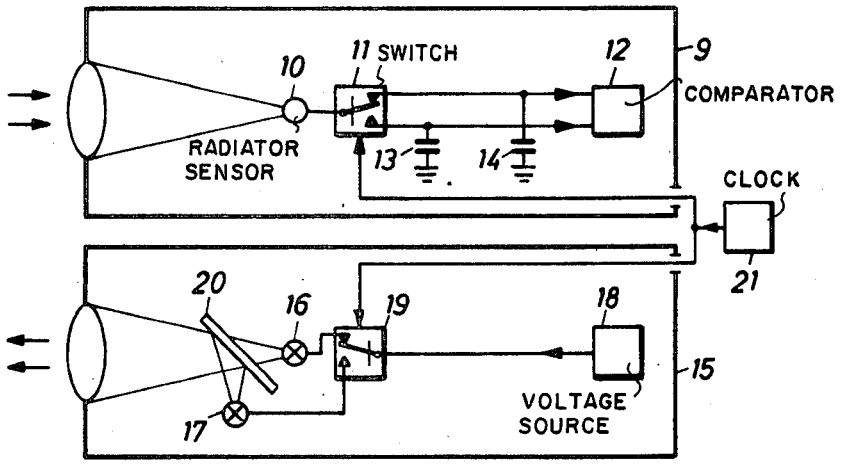
FIGS. 2 and 3 show alternative embodiments with only one radiation-detecting means in the optical fire detector according to the invention.

FIG. 2 shows a modified embodiment of the optical fire detector according to FIG. 1 where a radiation detector 9 utilizes only one radiation-sensing element 10 arranged to alternatively be connected through a switch 11 to a first and a second input of a comparator means 12 having the same function as the comparator means 8 in FIG. 1 but being provided with a memory on each input in the form of a capacitor 13 and 14, respectively. A radiation source 15 has two incandescent lamps 16 and 17 arranged to be alternately energized in synchronism with the alternating connection of the radiation-sensing element 10 to the comparator means 12 by being connected to a voltage source 18 through a switch 19. In order that an outgoing beam of radiation from the radiation source 15 will include two time-multiplexed first and second wavelength bands, a dichroic filter 20, corresponding to the filter 7 in FIG. 1, is placed in the path of the outgoing beam of radiation from the one incandescent lamp 16 and is arranged in an angle of 45° relative thereto. The other incandescent lamp 17 is placed so that its outgoing beam of radiation is reflected by the dichroic filter 20 into the same path as the outgoing beam of radiation from the incandescent lamp 16. The switches 11 and 19 in the radiation detector 9 and the radiation source 15 respectively are, via a respective control input, commonly connected to an output of an external clock pulse generator 21 in order to obtain the required synchronous function.

Figure 3:
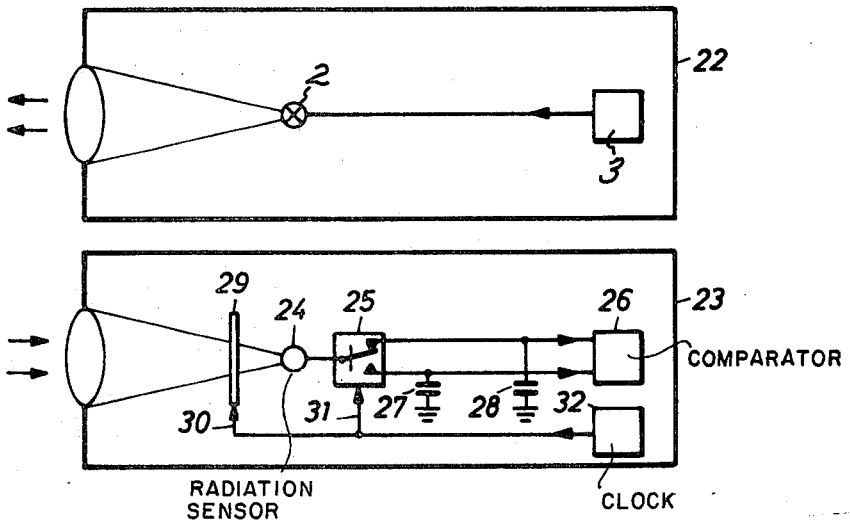

FIG. 3 shows an alternative modification of the optical fire detector according to FIG. 1 where a radiation source 22 completely corresponds to the radiation source 1 in FIG. 1 and a radiation detector 23 utilizes only one radiation sensing element 24 arranged to alternatively be connected through a switch 25 to a first and a second input of a comparator means 26 having the same function as the comparator means 8 in FIG. 1 and as the comparator means 12 in FIG. 2. The inputs of the comparator means 26 are provided with a memory in the form of a capacitor 27 and 28 respectively. An optical interference filter 29 has an electric control input 30 which is common with a control input 31 of the switch 25 connected to an output of a clock pulse generator 32 so that the radiation-sensing element 24 will receive a beam of radiation which is generated by reflection of an outgoing beam of radiation from the radiation source 22. The filter 29 includes a first and second wavelength pass band which is time-multiplexed by the interference filter 29 in synchronism with the alternating connection of the radiation sensingelement 24 to the comparator means 26. The interference filter 29 is for example of the type that is described in the Journal Electronics Letters (GB), Vol 11, No 19, 18th Sept, 1975, pp 471–2.

In the above described embodiments of the optical fire detector according to the invention a selective measurement of the intensity is made within a first and a second wavelength band of a beam of radiation which has passed through an intermediate air medium. Then the measured intensities are mutually compared, and an alarm is provided upon a predetermined difference between these intensities. Thus the invention is based on the knowledge that fire gases obscure a beam of radiation differently within separate wavelength bands. An early alarm can be provided for a fire by making a suitable choice of such wavelength bands. Upon the combustion of for example polyvinyl chloride substances an early alarm is obtained if one of the wavelength bands is limited to the narrow interval 1.7–1.8 $\mu$m.

The sensitivity to disturbances of the optical fire detector according to the invention may in a manner known per se be minimized. For example, the radiation source is intensity modulated and the radiation detector is made frequency selective with reference to the frequency of the intensity modulation of the radiation source.

The invention is not limited to the described embodiments but can be modified in many ways within the scope of the appended claims. For example, the incandescent lamps 16 and 17 and the dichroic filter 20 in FIG. 2 can be replaced by two light emitting diodes arranged to emit green and red light respectively and to be alternately connected to the voltage source 18 through the switch 19. A further possibility is to replace these two light emitting diodes with only one light emitting diode having so called multi dichroic operation which is produced in a monolytic substrate. Such a diode is arranged to be alternately and in synchronism with the alternating connection of the radiation sensing element 10 to the comparator means 12 connected to a first and a second voltage providing an outgoing radiation within a first and a second wavelength band respectively.

We claim:

1. Optical fire detector in which a radiation-emitting means is arranged to emit a beam of radiation and a radiation-detecting means is arranged to receive the beam of radiation after it has passed through an intermediate air medium and to provide an alarm upon an obscuration of the beam of radiation, the radiation-detecting means comprising first means for individually measuring the intensity in a first and a second wavelength band of the beam of radiation and second means for comparing the individually measured intensities and providing said alarm upon a predetermined difference between them, said first means including a radiation-sensing element arranged to switch between a first and a second input of said second means, at least one of said inputs being provided with a memory, and third means being arranged to alternately divide the beam of radiation into the two wavelength bands in synchronism with the alternating switching of the radiation-sensing element.

2. Optical fire detector according to claim 1, wherein said third means is included in the radiation-emitting means and comprises two radiation-emitting elements which are arranged to alternately be activated for an emission within the first and second wavelength bands respectively.

3. Optical fire detector according to claim 1, wherein said third means is included in the radiation detecting means and comprises an optical filter which is electrically turnable for alternately transmitting within the first and second wavelength bands respectively.

* * * * *